US011976820B2

(12) United States Patent
Snyder

(10) Patent No.: US 11,976,820 B2
(45) Date of Patent: May 7, 2024

(54) MULTI-FUELED, WATER INJECTED HYDROGEN FUEL INJECTOR

(71) Applicant: RTX Corporation, Farmington, CT (US)

(72) Inventor: Timothy S. Snyder, Glastonbury, CT (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 17/881,817

(22) Filed: Aug. 5, 2022

(65) Prior Publication Data

US 2024/0044496 A1 Feb. 8, 2024

(51) Int. Cl.

| | |
|---|---|
| ***F23R 3/00*** | (2006.01) |
| ***F23R 3/14*** | (2006.01) |
| ***F23R 3/28*** | (2006.01) |

(52) U.S. Cl.

CPC ..... *F23R 3/286* (2013.01); *F23R 3/14* (2013.01)

(58) Field of Classification Search

CPC ..... F23R 3/286; F23R 3/14; F23R 3/343
See application file for complete search history.

(56) References Cited

U.S. PATENT DOCUMENTS

| | | | | |
|---|---|---|---|---|
| 4,600,151 | A | 7/1986 | Bradley | |
| 5,505,045 | A | 4/1996 | Lee et al. | |
| 8,621,870 | B2 | 1/2014 | Carroni et al. | |
| 2001/0023590 | A1* | 9/2001 | Mandai | F23R 3/14 60/747 |
| 2010/0205971 | A1* | 8/2010 | Williams | F23R 3/14 60/748 |
| 2010/0300105 | A1 | 12/2010 | Pelletier et al. | |
| 2014/0109587 | A1* | 4/2014 | Crothers | F02C 7/24 60/725 |
| 2014/0123661 | A1 | 5/2014 | Biagioli et al. | |
| 2014/0245738 | A1* | 9/2014 | Crothers | F23R 3/18 60/725 |
| 2014/0360202 | A1* | 12/2014 | Toon | F23R 3/343 60/776 |

(Continued)

FOREIGN PATENT DOCUMENTS

| | | |
|---|---|---|
| EP | 3220050 A1 | 9/2017 |

OTHER PUBLICATIONS

Extended European Search Report; Application No. 23190108.3; Dated Jan. 3, 2024; 8 Pages.

*Primary Examiner* — Katheryn A Malatek

(74) *Attorney, Agent, or Firm* — CANTOR COLBURN LLP

(57) ABSTRACT

Fuel injectors for gas turbine engines include a housing and a tube defining a portion of a first fluid passage therein and a second fluid passage is defined between an exterior surface of the tube and an interior surface of the housing. An inner airflow tube is arranged having an inflow vane assembly and a central air passage. A portion of the first fluid passage extends axially at a position radially outward from the inner airflow tube, and the third fluid passage extends axially at a position radially outward from the first fluid passage. A nozzle outlet is configured to receive first, second, and thirds fluids from the respective fluid passages to cause mixing thereof. The inflow vane assembly comprises a number of vanes, with each vane angled relative to a nozzle axis at an angle between 20° and 40°.

16 Claims, 7 Drawing Sheets

(56) References Cited

U.S. PATENT DOCUMENTS

| | | | | |
|---|---|---|---|---|
| 2016/0209037 | A1* | 7/2016 | Dai | F23R 3/36 |
| 2020/0003421 | A1 | 1/2020 | Sanchez | |
| 2023/0194092 | A1* | 6/2023 | Naik | F23R 3/28 60/737 |

* cited by examiner

MULTI-FUELED, WATER INJECTED HYDROGEN FUEL INJECTOR

BACKGROUND

The subject matter disclosed herein generally relates to components for combustors in turbine engines and, more particularly, to improved cooling and operation of injectors for combustors of turbine engines such as for use with hydrogen fuel.

Aircraft turbine engines, such as those that power modern commercial and military aircraft, include a compressor section to pressurize a supply of air, a combustor section to burn a fuel in the presence of the pressurized air, and a turbine section to extract energy from the resultant combustion gases to generate thrust. The combustor section generally includes a plurality of circumferentially distributed fuel injectors that project toward a combustion chamber to supply fuel to be mixed and burned with the pressurized air. Aircraft turbine engines typically include a plurality of centralized staging valves in combination with one or more fuel supply manifolds that deliver fuel to the fuel injectors.

Each fuel injector typically has an inlet fitting connected to the manifold at the base, a conduit connected to the base fitting, and a nozzle connected to the conduit to spray the fuel into the combustion chamber. Appropriate valves or flow dividers are provided to direct and control the flow of fuel through the nozzle.

Some current aircraft fuel injectors are configured for and optimized for dual fuel (e.g., No. 2 Fuel Oil and Methane) with water injection to reduce NOx. As the aircraft industry transitions away from using hydrocarbon-based fuels, there is a desire to mix hydrogen with Methane at very high levels, up to and including 100% hydrogen. Because of the high flame speeds and reaction rates of hydrogen, flashback can occur at high pressure and temperature allowing the flame to attach on the gas fuel swirl vanes causing damage. As such, improved systems may be necessary to implement hydrogen use in aircraft combustion systems.

SUMMARY

According to embodiments of the present disclosure, fuel injectors for gas turbine engines are provided. The fuel injectors include a housing, a tube arranged in the housing and defining a portion of a first fluid passage therein, the first fluid passage configured to contain a first fluid, wherein a second fluid passage is defined, in part, between an exterior surface of the tube and an interior surface of the housing, the second fluid passage configured to contain a second fluid, an inner airflow tube having an inflow vane assembly, the air inflow tube arranged along a nozzle axis, said inner airflow tube defining a central air passage and configured to contain a third fluid, wherein the first fluid passage extends axially at a position radially outward from the inner airflow tube, and the third fluid passage extends axially at a position radially outward from the first fluid passage, and a nozzle outlet configured to receive each of the first fluid, the second fluid, and the third fluid to cause mixing thereof. The inflow vane assembly includes a plurality of vanes, wherein each vane of the plurality of vanes is angled relative to the nozzle axis at an angle between 20° and 40°.

In addition to one or more of the features described above, or as an alternative, further embodiments of the fuel injectors may include a plurality of angled vanes arranged along the second fluid passage of the second fluid, wherein the angled vanes are positioned a separation distance $S_d$ from the nozzle outlet a distance that is equal to or greater than five times a radial height $H_v$ of the plurality of angled vanes.

In addition to one or more of the features described above, or as an alternative, further embodiments of the fuel injectors may include a tapering passage extending from the plurality of angled vanes to the nozzle outlet, wherein the tapering passage comprises a passage having a radial height that decreases from the plurality of angled vanes to the outlet.

In addition to one or more of the features described above, or as an alternative, further embodiments of the fuel injectors may include that the second fluid passage comprises a tapering passage at an end of the second fluid passage that exits to the nozzle outlet, wherein the tapering passage comprises a passage having a radial height that decreases in dimension in a direction toward the nozzle outlet.

In addition to one or more of the features described above, or as an alternative, further embodiments of the fuel injectors may include that the inflow vane assembly comprises eight vanes.

In addition to one or more of the features described above, or as an alternative, further embodiments of the fuel injectors may include that the second fluid is a gaseous fuel comprising at least 30% hydrogen.

In addition to one or more of the features described above, or as an alternative, further embodiments of the fuel injectors may include that the second fluid is a gaseous fuel comprising 100% hydrogen.

In addition to one or more of the features described above, or as an alternative, further embodiments of the fuel injectors may include that the first fluid is a liquid fuel and the third fluid is air.

In addition to one or more of the features described above, or as an alternative, further embodiments of the fuel injectors may include that the inner airflow tube defines an inner third fluid passage and an outer third fluid passage is defined radially outward relative to the first fluid passage relative to the nozzle axis.

According to some embodiments, fuel injectors for gas turbine engines are provided. The fuel injectors include a housing, a tube arranged in the housing and defining a portion of a first fluid passage therein, the first fluid passage configured to contain a first fluid, wherein a second fluid passage is defined, in part, between an exterior surface of the tube and an interior surface of the housing, the second fluid passage configured to contain a second fluid, an inner airflow tube having an inflow vane assembly, the air inflow tube arranged along a nozzle axis, said inner airflow tube defining a central air passage and configured to contain a third fluid, wherein the first fluid passage extends axially at a position radially outward from the inner airflow tube, and the third fluid passage extends axially at a position radially outward from the first fluid passage, a nozzle outlet configured to receive each of the first fluid, the second fluid, and the third fluid to cause mixing thereof, and a plurality of angled vanes arranged along the second fluid passage of the second fluid, wherein the angled vanes are positioned a separation distance $S_d$ from the nozzle outlet a distance that is equal to or greater than five times a radial height $H_v$ of the plurality of angled vanes.

In addition to one or more of the features described above, or as an alternative, further embodiments of the fuel injectors may include that the inflow vane assembly comprises a plurality of vanes each being angled relative to the nozzle axis at an angle between 20° and 40°.

In addition to one or more of the features described above, or as an alternative, further embodiments of the fuel injectors may include a tapering passage extending from the plurality of angled vanes to the nozzle outlet, wherein the tapering passage comprises a passage having a radial height that decreases from the plurality of angled vanes to the outlet.

In addition to one or more of the features described above, or as an alternative, further embodiments of the fuel injectors may include that the inflow vane assembly comprises eight vanes.

In addition to one or more of the features described above, or as an alternative, further embodiments of the fuel injectors may include that the second fluid is a gaseous fuel comprising at least 30% hydrogen.

In addition to one or more of the features described above, or as an alternative, further embodiments of the fuel injectors may include that the second fluid is a gaseous fuel comprising 100% hydrogen.

In addition to one or more of the features described above, or as an alternative, further embodiments of the fuel injectors may include that the first fluid is a liquid fuel.

In addition to one or more of the features described above, or as an alternative, further embodiments of the fuel injectors may include that the inner airflow tube defines an inner third fluid passage and an outer third fluid passage is defined radially outward relative to the first fluid passage relative to the nozzle axis.

According to some embodiments, fuel injectors for gas turbine engines are provided. The fuel injectors include a housing, a tube arranged in the housing and defining a portion of a first fluid passage therein, the first fluid passage configured to contain a first fluid, wherein a second fluid passage is defined, in part, between an exterior surface of the tube and an interior surface of the housing, the second fluid passage configured to contain a second fluid, an inner airflow tube having an inflow vane assembly, the air inflow tube arranged along a nozzle axis, said inner airflow tube defining a central air passage and configured to contain a third fluid, wherein the first fluid passage extends axially at a position radially outward from the inner airflow tube, and the third fluid passage extends axially at a position radially outward from the first fluid passage, and a nozzle outlet configured to receive each of the first fluid, the second fluid, and the third fluid to cause mixing thereof. The second fluid passage includes a tapering passage at an end of the second fluid passage that exits to the nozzle outlet, wherein the tapering passage comprises a passage having a radial height that decreases in dimension in a direction toward the nozzle outlet.

In addition to one or more of the features described above, or as an alternative, further embodiments of the fuel injectors may include a plurality of angled vanes arranged along the second fluid passage of the second fluid, wherein the angled vanes are positioned a separation distance $S_d$ from the nozzle outlet a distance that is equal to or greater than five times a radial height $H_v$ of the plurality of angled vanes.

In addition to one or more of the features described above, or as an alternative, further embodiments of the fuel injectors may include that a length of the tapering passage is equal to the separation distance Sa.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
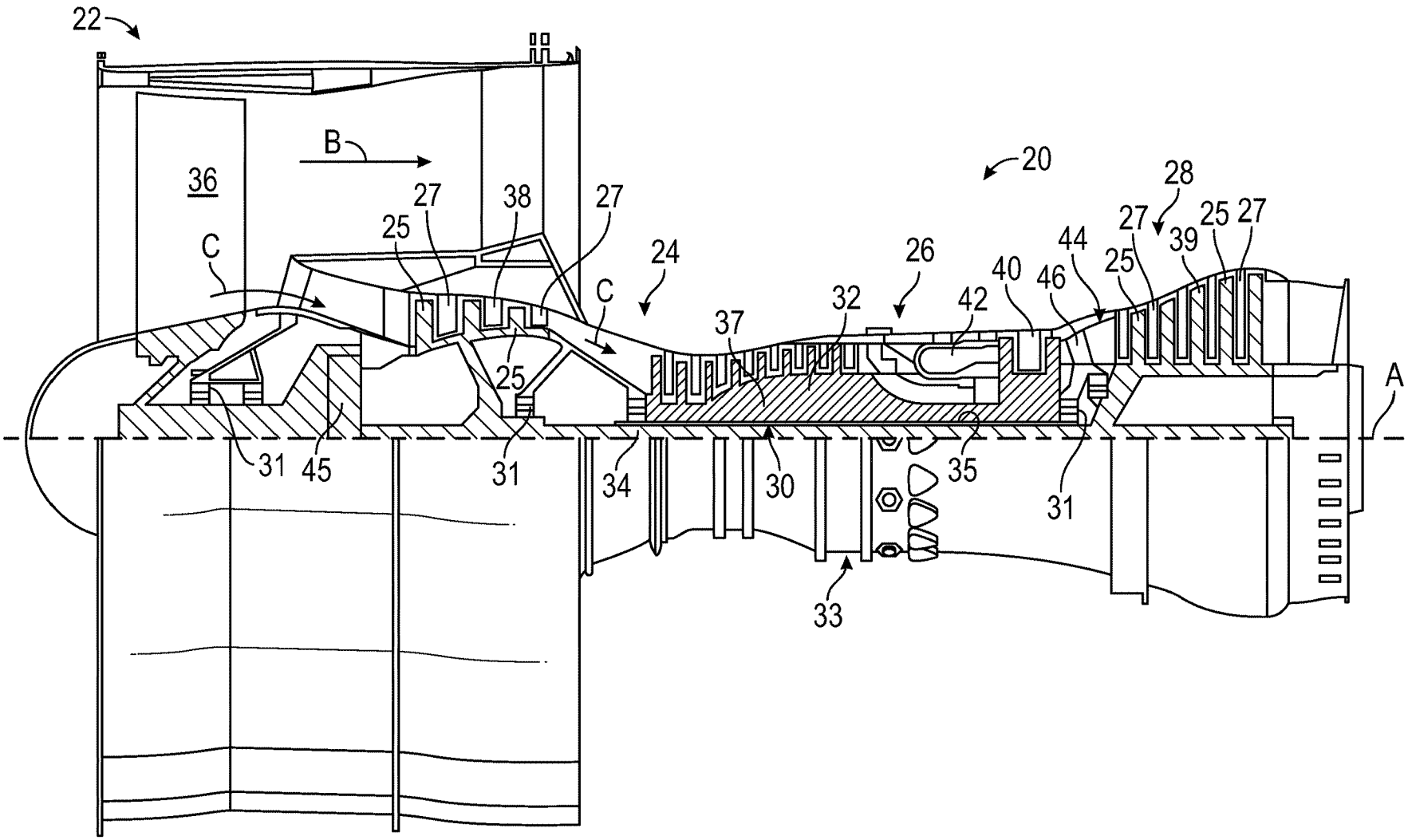
FIG. 1 is a schematic cross-sectional illustration of an aircraft turbine engine that may incorporate embodiments disclosed herein.

FIG. 1 schematically illustrates a gas turbine engine 20. The illustrative, example gas turbine engine 20 is a two-spool turbofan engine that generally incorporates a fan section 22, a compressor section 24, a combustor section 26, and a turbine section 28. The fan section 22 drives air along a bypass flow path B, while the compressor section 24 drives air along a core flow path C for compression and communication into the combustor section 26. The core flow path C directs compressed air into the combustor section 26 for combustion with a fuel. Hot combustion gases generated in the combustor section 26 are expanded through the turbine section 28. Although depicted as a turbofan gas turbine engine, it should be understood that the concepts described herein are not limited to turbofan engines and these teachings could extend to other types of engines.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39.

The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded across the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, a bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only examples of one embodiment of a geared architecture engine and that the present disclosure is applicable to other gas turbine engines, including direct drive turbofans.

In an embodiment of the gas turbine engine 20, a significant amount of thrust may be provided by the bypass flow path B due to the high bypass ratio. The fan section 22 of the gas turbine engine 20 is designed for a particular flight condition—typically cruise at about 0.8 Mach and about 35,000 feet (10,668 meter). This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(T_{ram}° R)/(518.7° R)]^{0.5}$, where $T_{ram}$ represents the ambient temperature in degrees Rankine. The Low Corrected Fan Tip Speed according to one non-limiting embodiment of the example gas turbine engine 20 is less than about 1150 feet per second (fps) (351 meters per second (m/s)).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from the core airflow that is communicated through the gas turbine engine 20 along the core flow path C. The vanes 27 of the vane assemblies direct the core airflow to the blades 25 to either add or extract energy.

Figure 2:
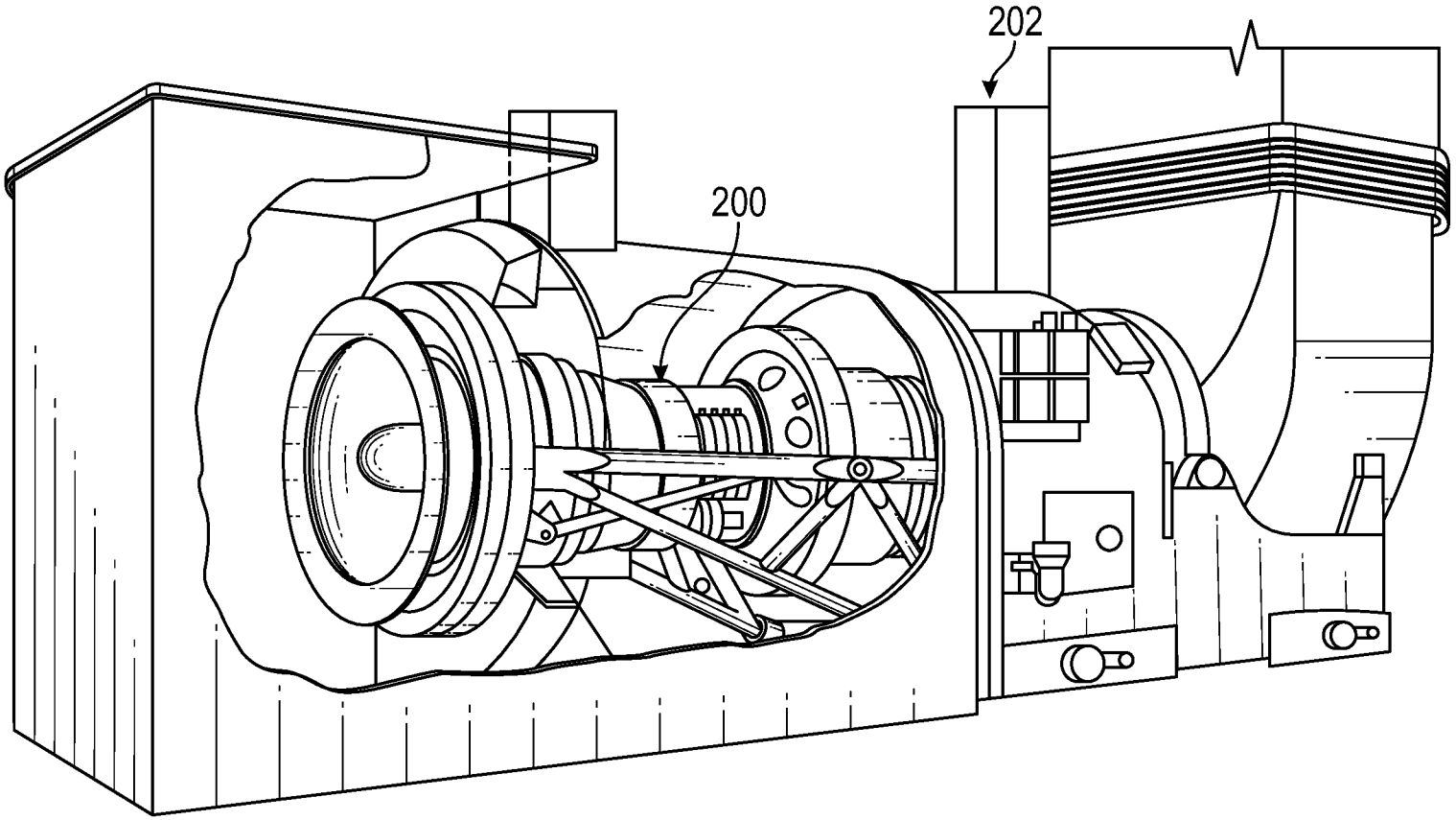
FIG. 2 is a schematic illustration of an industrial turbine engine that may incorporate embodiments of the present disclosure.

FIG. 2 illustrates an industrial turbine engine architecture 200 that is located within an enclosure 202. The industrial turbine engine architecture 200 may be similar to that shown and described above with respect to FIG. 1. The industrial turbine engine architecture 200 may be configured with embodiments and features described herein.

Figure 3:
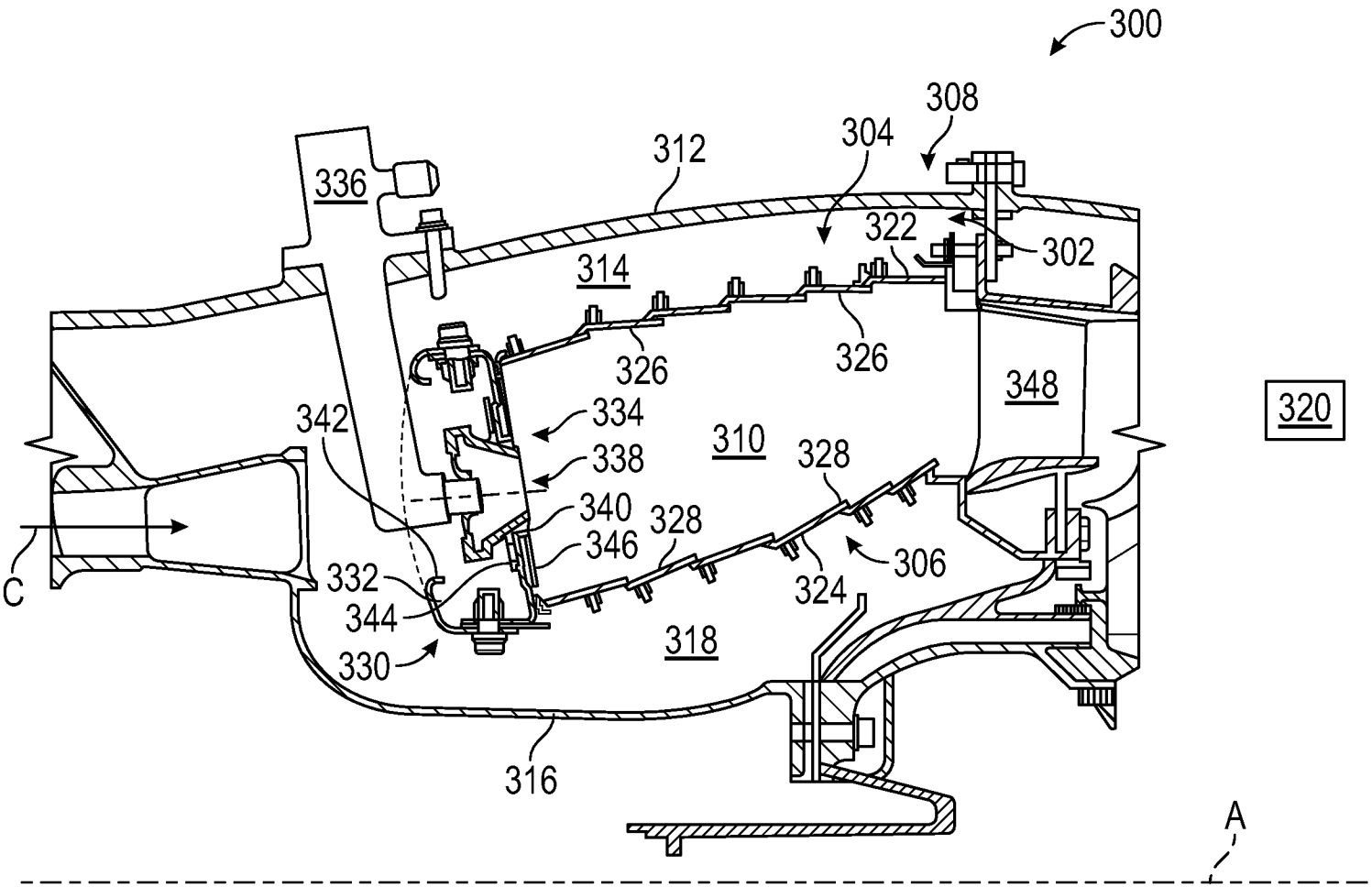
FIG. 3 is a schematic illustration of a combustion section of a turbine engine that may incorporate embodiments of the present disclosure.

Turning now to FIG. 3, a combustor section 300 for use in an aircraft or industrial turbine engine is schematically shown. The combustor section includes a combustor 302 with an outer combustor wall assembly 304, an inner combustor wall assembly 306, and a diffuser case 308. The outer combustor wall assembly 304 and the inner combustor wall assembly 306 are spaced apart such that a combustion chamber 310 is defined therebetween. The combustion chamber 310 may be generally annular in shape.

The outer combustor wall assembly 304 is spaced radially inward from an outer diffuser case 312 of the diffuser case 308 to define an outer annular plenum 314. The inner combustor wall assembly 306 is spaced radially outward from an inner diffuser case 316 of the diffuser case 308 to define an inner annular plenum 318. It should be understood that although a particular combustor arrangement is illustrated, other combustor types, such as can combustors, with various combustor liner/wall arrangements will also benefit from embodiments of the present disclosure.

The combustor wall assemblies 304, 306 contain the combustion products for direction toward a turbine section 320 of a turbine engine. Each combustor wall assembly 304, 306 generally includes a respective support shell 322, 324 which supports one or more liner panels 326, 328, respectively mounted to a hot side of the respective support shell 322, 324. Each of the liner panels 326, 328 may be generally rectilinear and manufactured of, for example, a nickel based super alloy, ceramic or other temperature resistant material and are arranged to form a liner array. In one disclosed non-limiting embodiment, the liner array may include a multiple of forward liner panels and a multiple of aft liner panels that are circumferentially staggered to line the hot side of the outer support shell 322. A multiple of forward liner panels and a multiple of aft liner panels may be circumferentially staggered to line the hot side of the inner shell 324.

The combustor 302 further includes a forward assembly 330 immediately downstream of a compressor section of the engine to receive compressed airflow therefrom. The forward assembly 330 generally includes an annular hood 332 and a bulkhead assembly 334 which locate a multiple of fuel nozzles 336 (one shown) and a multiple of swirlers 338 (one shown). Each of the swirlers 338 is mounted within an opening 340 of the bulkhead assembly 334 to be circumferentially aligned with one of a multiple of annular hood ports 342. Each bulkhead assembly 334 generally includes a bulkhead support shell 344 secured to the combustor wall assembly 304, 306, and a multiple of circumferentially distributed bulkhead liner panels 346 secured to the bulkhead support shell 344.

The annular hood 332 extends radially between, and is secured to, the forwardmost ends of the combustor wall assemblies 304, 306. The annular hood 332 forms the multiple of circumferentially distributed hood ports 342 that accommodate the respective fuel nozzle 336 and introduce air into the forward end of the combustion chamber 310. Each fuel nozzle 336 may be secured to the diffuser case module 308 and project through one of the hood ports 342 and the respective swirler 338.

In operation, the forward assembly 330 introduces core combustion air into the forward section of the combustion chamber 310 while the remainder enters the outer annular plenum 314 and the inner annular plenum 318. The multiple of fuel nozzles 336 and adjacent structure generate a blended fuel-air mixture that supports stable combustion in the combustion chamber 310.

Opposite the forward assembly 330, the outer and inner support shells 322, 324 are mounted to a first row of Nozzle Guide Vanes (NGVs) 348. The NGVs 348 are static engine components which direct the combustion gases onto turbine blades in a turbine section of the engine to facilitate the conversion of pressure energy into kinetic energy. The combustion gases are also accelerated by the NGVs 348 because of a convergent shape thereof and are typically given a "spin" or a "swirl" in the direction of turbine rotation.

Although FIG. 3 is illustrative of a specific combustor section configuration, those of skill in the art will appreciate that other combustor configurations may benefit from embodiments of the present disclosure. For example, can combustors, annular combustors, can-annular combustors, and other types of combustors may implement or be configured with embodiments of the present disclosure.

Figure 4A:
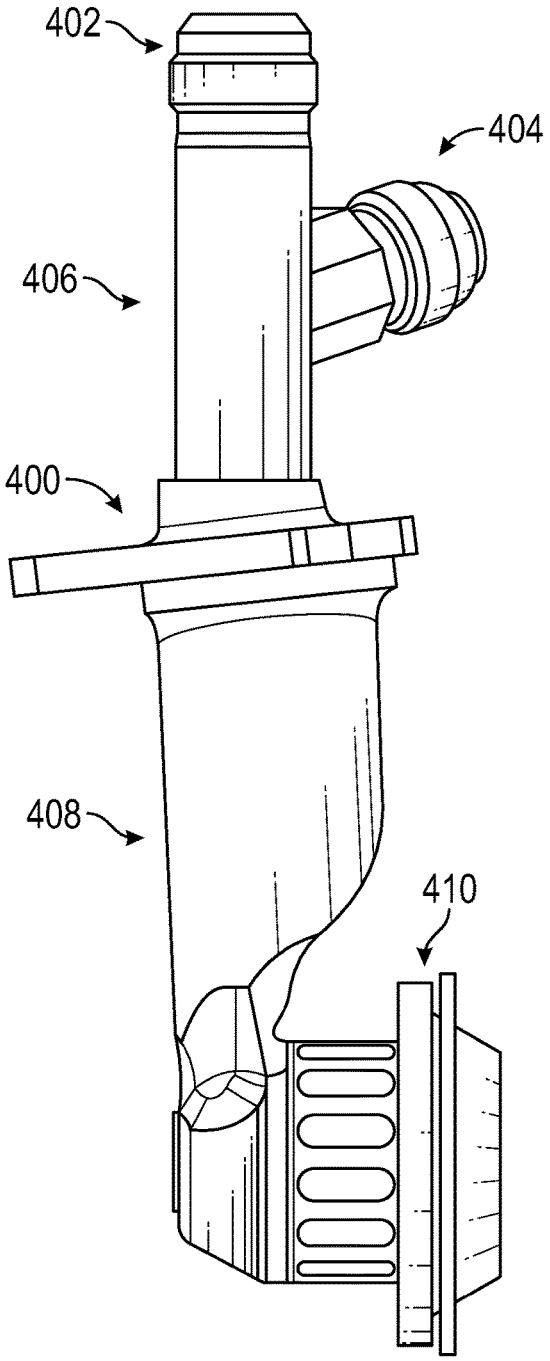
FIG. 4A is a side elevation view of a nozzle assembly that may incorporate embodiments of the present disclosure.
Figure 4B:
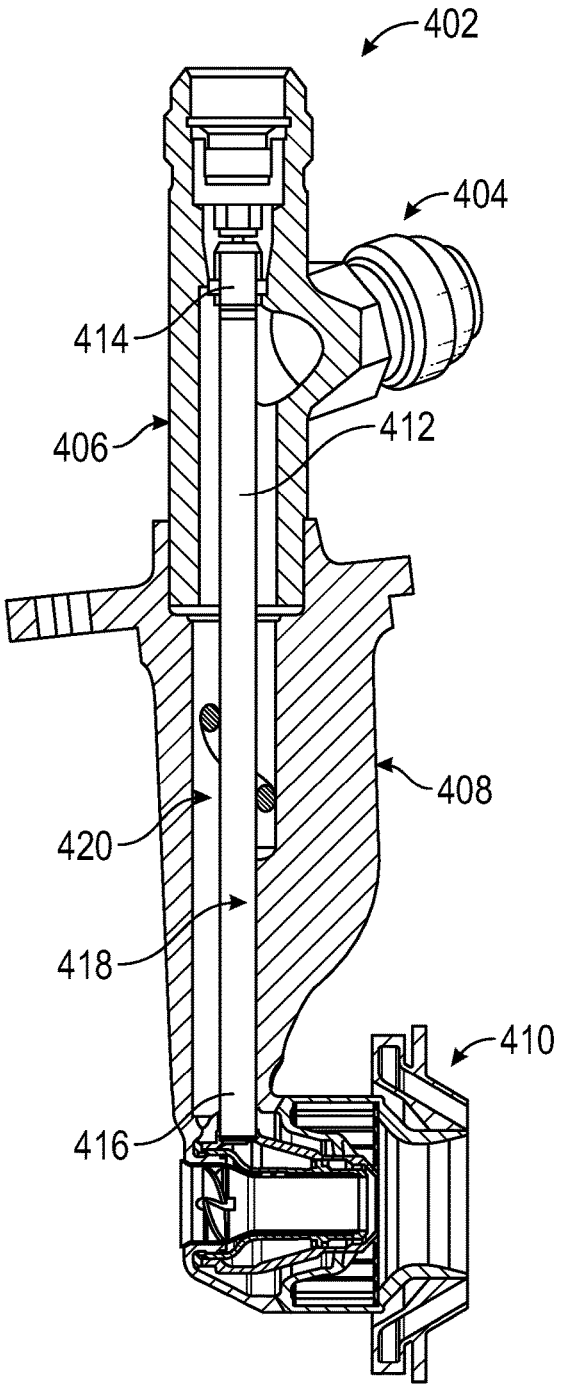
FIG. 4B is a cross-sectional view of the nozzle assembly of FIG. 4A.

Referring now to FIGS. 4A-4B, schematic illustrations of a fuel injector 400 for use in combustors and combustor sections of turbine engines and in accordance with embodiments of the present disclosure are illustratively shown. The fuel injector 400 may be implemented in the above described combustors and engine configurations, and variations thereon. FIG. 4A illustrates a side elevation view of the fuel injector 400 and FIG. 4B illustrates a cross-sectional view of the fuel injector 400.

As shown, the fuel injector 400 includes a first inlet 402 and a second inlet 404 defined by an inlet housing 406, a support housing 408, and a nozzle assembly 410. In some embodiments, and as shown, the first inlet 402 is arranged transverse to the second inlet 404. The inlet housing 406 is received within the support housing 408 and a tube 412 extends through the housings 406, 408 (e.g., as shown FIG. 4B).

The first inlet 402 may receive a first fluid such as a liquid and the second inlet 404 may receive a second fluid such as a gas. The fuel injector 400 provides for concentric passages for the first fluid and the second fluid. For example, in some embodiments, the first fluid may be a liquid state of Jet-A, diesel, JP8, water and combinations thereof, and the second fluid may be a gas, such as natural gas or methane. Each of the fluids are communicated through separate concentric passages within the fuel injector 400 such that gas turbine engine readily operates on either fuel or combinations thereof. For example, in the illustrative embodiment, the tube 412 provides a barrier between the first fluid (e.g., within the tube 412 and sourced from the first inlet 402) and the second fluid (e.g., in a space around the tube 412 and sourced from the second inlet 404). As noted, the first fluid may be in a liquid state and the second fluid may be in a gaseous state.

The tube 412 is secured within the inlet housing 406 at a first end 414 and secured in or to the nozzle assembly 410 at a second end 416. The connection at the first end 414 may include a seal, such as an O-ring, or the like. The connection at the second end 416 may be via a braze, weld, thread, or other attachment to the nozzle assembly 410. The tube 412 defines an first fluid passage 418 within the tube 412 and a second fluid passage 420 defined between an exterior surface of the tube 412 and an interior surface of the housings 406, 408. The second fluid passage 420 may be an annular passage that surrounds the tube 412 along a length of the fuel injector 400. The second fluid passage 420 defined within the housings 406, 408 and around the tube 412 provides for a buffer or heat shield to minimize or prevent coking of the fluid passing through the first fluid passage 418 within the tube 412. The first fluid and the second fluid may be mixed and joined together at the nozzle assembly 410.

Figure 5:
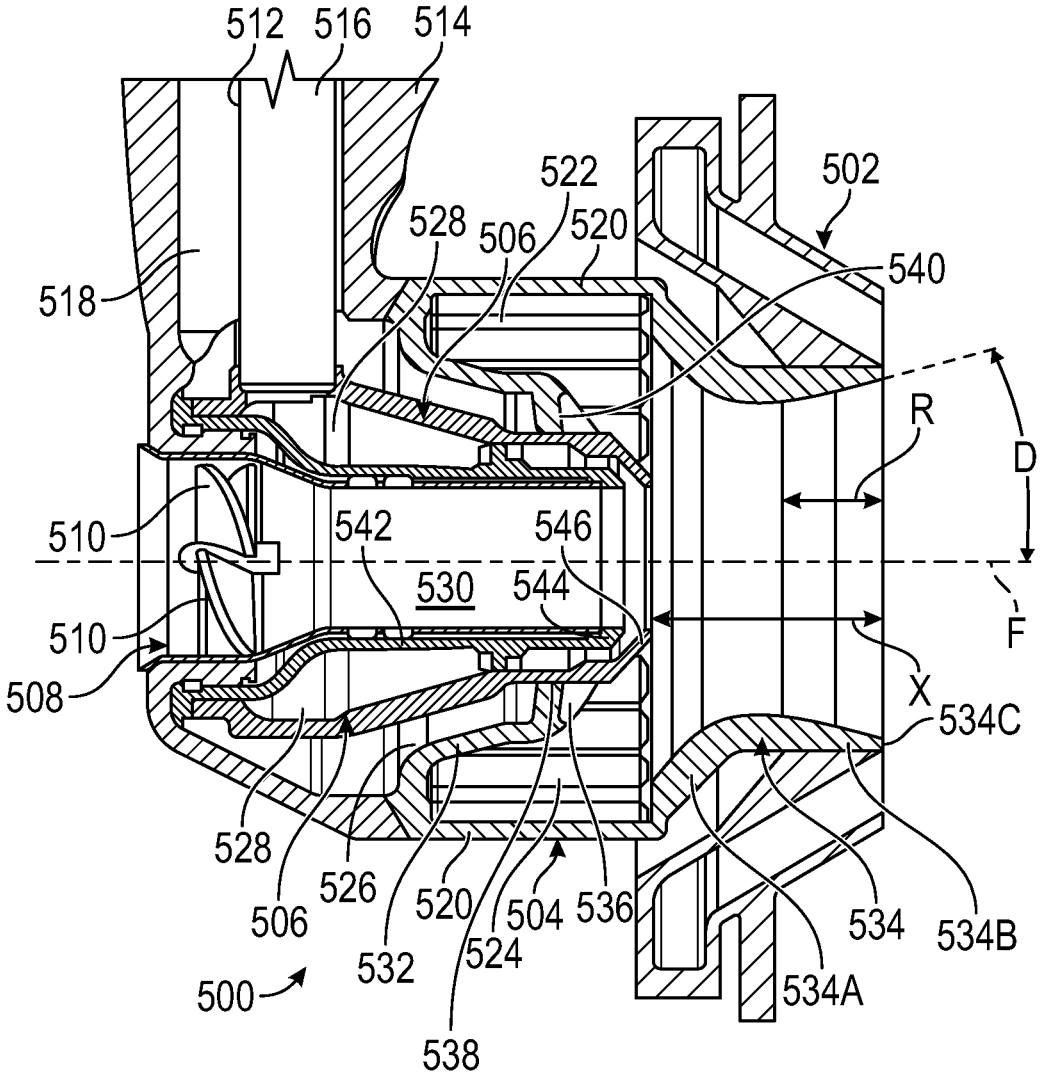
FIG. 5 is a schematic illustration of a nozzle assembly that may incorporate embodiments of the present disclosure.

Referring now to FIG. 5, a schematic cross-sectional view of a nozzle assembly 500. The nozzle assembly 500 includes a swirler 502 with various components arranged within and relative to the swirler 502. The nozzle assembly 500 includes an outer air swirler 504, an inner air swirler 506, and an air inflow tube 508 with a helical inflow vane assembly 510 arranged along a nozzle axis F. The nozzle assembly 500 includes a structure similar to the fuel injector described above, with a tube 512 arranged within a housing 514 and defining a first fluid passage 516 and a second fluid passage 518.

An outer wall 520 of the outer air swirler 504 includes a multiple of axial slots 522 which receive airflow therethrough. An outer annular air passage 524 is defined around the axis F and within the outer air swirler 504. An annular fuel gas passage 526 is defined around the axis F and between the outer air swirler 504 and the inner air swirler 506. The annular fuel gas passage 526 receives fluid (e.g., gaseous fuel) from within the second fluid passage 518. An annular liquid passage 528 is defined around the axis F and within the inner air swirler 506. The annular liquid passage 528 receives fluid (e.g., liquid fuel) from the first fluid passage 516 of the tube 512. A central air passage 530 is defined along the axis F within the air inflow tube 508.

The outer annular air passage 524 is generally defined between the outer wall 520 and an inner wall 532 of the outer air swirler 504. An end section 534 of the outer wall 520 extends beyond an end section 536 of the inner wall 532 and the annular liquid passage 528. The end section 534 of the outer wall 520 includes a convergent section 534A that transitions to a divergent section 534B and terminates at a distal end 534C. That is, the end section 534 defines a convergent-divergent nozzle with an essentially asymmetric hourglass-shape downstream of the inner air swirler 506 and the air inflow tube 508.

In one illustrative and non-limiting embodiment, the divergent section 534B defines an angle D of between about zero to thirty (0-30) degrees with respect to the axis F. The end section 534 defines a length X which. The length X, in this non-limiting example, may be about 0-0.75 inches (0-19 mm) in length along the axis F with a filming region R of about 0-0.4 inches (0-10 mm). That is, the length of the filming region R defines from about 0-55% of the length X of the end section 534. The filming region R may extend to the distal end 534C of the divergent section 534B. It should be appreciated that various other geometries of the outer air swirler 504 may benefit from embodiments described herein.

The end section 536 of the inner wall 532 abuts an outer wall 538 of the inner air swirler 506 to defines a multiple of angled vanes or vanes 540, which may be arranged and oriented as skewed slots to form an axial swirled exit for the annular gas passage 526. That is, the annular gas passage 526 terminates with the multiple of angled vanes 540 to direct the fuel gas axially and imparts a swirl thereto. In other embodiments, the annular gas passage 526 may terminates with a multiple of openings that are generally circular passages. It should be appreciated that other geometries may alternatively be provided without departing from the scope of the present disclosure. The annular gas passage 526 communicates essentially all, e.g., about one hundred (100) percent of the fuel gas through the multiple of angled vanes 540. The multiple of angled vanes 540 will decrease the injection area and increase axial swirl momentum to increase circumferential uniformity and total air swirl due to the angle of gas injection and increase in air stream mixing downstream of the nozzle assembly 500 to facilitate fuel-air mixing. Each of the multiple of angled vanes 540 may be arranged as skewed quadrilaterals in shape. In some such embodiments, the multiple of angled vanes 540 may be skewed at an angle between about fifty to sixty degrees) (50°-60° around the axis F. The outer wall 538 and an inner wall 542 of the inner air swirler 506 define the annular liquid passage 528. An end section 544 of the outer wall 538 and an end section 546 of the inner wall 542 may be turned radially inward toward the axis F to direct the liquid at least partially radially inward.

The air inflow tube 508 is mounted within the inner wall 542 and includes the upstream helical inflow vane assembly 510 to swirl an airflow passing therethrough. Due in part to the swirled airflow through the air inflow tube 508, the liquid spray expands from the annular liquid passage 528 and impacts upon the filming region R to re-film/re-atomize the fluids as they are injected into a combustion chamber. The increased liquid injection recession causes large drops to re-film/re-atomization on the larger wall surface of the divergent section 534B, resulting in smaller drop size and higher penetration which increases a water vaporization rate as well as positioning water in desirable locations for the combustion process. The reduced water drop size and the effective utilization of water facilitates a decrease in NOx emissions with reduced water injection (i.e. lower water-to-fuel ratio).

The above described fuel injector may be useful for dual-fuel operation (e.g., No. 2 Fuel Oil and Methane) with water injection to reduce NOx. For example, water may be provided through the first inlet and the tube and mixed with a gas fuel, or water may be mixed with a liquid fuel (e.g., Jet A, No. 2 Fuel Oil, etc.). The gas fuel may be methane or propane, and in some embodiments a mixture of methane and hydrogen may be provided through the second inlet and passed through the second fluid passage around the tube. It may be advantageous to increase the amount of hydrogen that is used in such systems, such as mixing the hydrogen with methane at very high levels up to and including 100% hydrogen (e.g., no methane at the maximum configuration). However, because of the high flame speeds and reaction rates of hydrogen, flashback can occur at high pressure and temperature allowing the flame to attach on the gas fuel swirl vanes causing damage (e.g., angled vanes 540). That is, by increasing the amount of hydrogen within the gas fuel, flashback or other negative impacts may occur.

Figure 6:
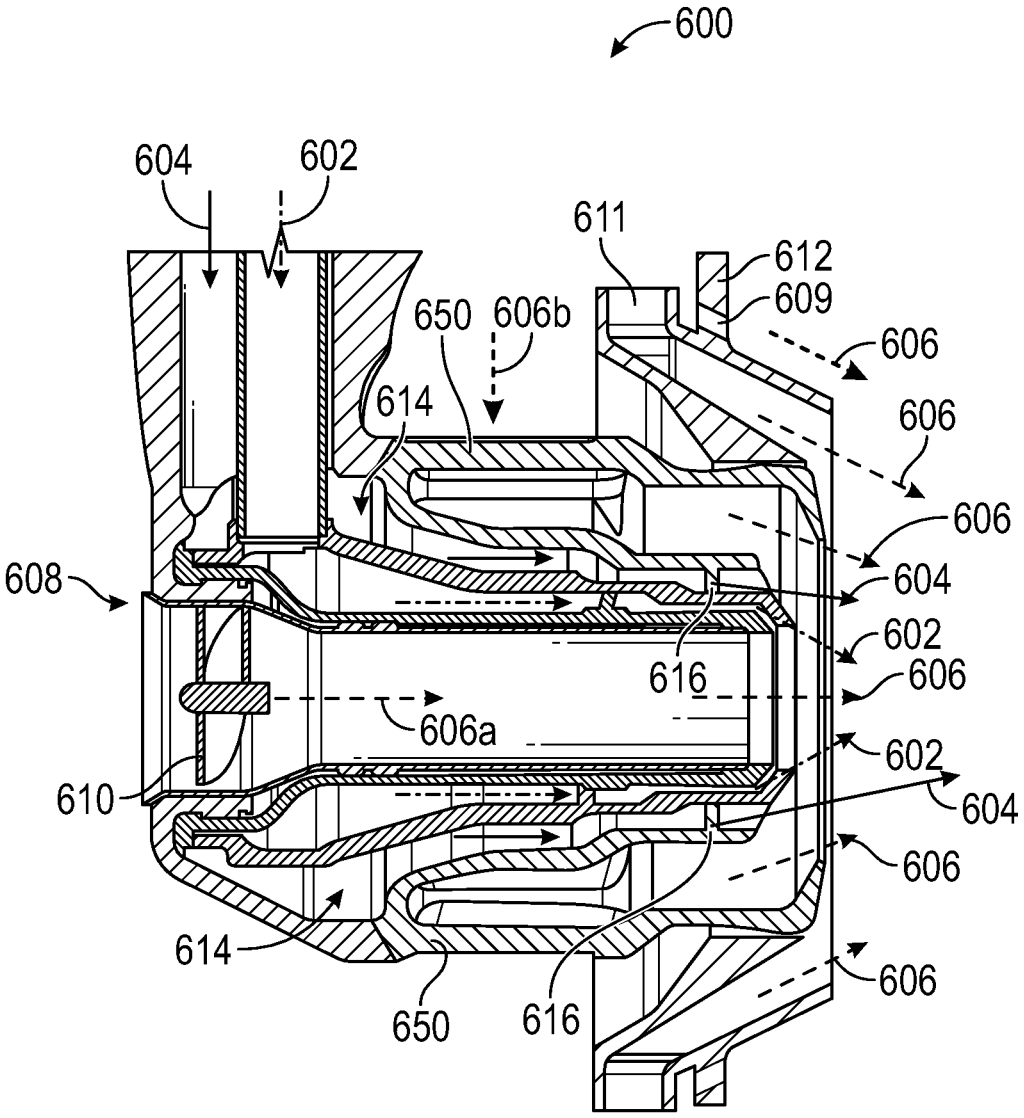
FIG. 6 is a schematic illustration showing fluid flow through a nozzle assembly.

For example, referring now to FIG. 6 a schematic illustration of flow of fluids through a nozzle assembly 600 in accordance with an embodiment of the present disclosure is shown. The nozzle assembly 600 may be similar to that shown and described above, providing dual-fuel injection of fuel into a combustion chamber of a turbine engine. A first fluid 602 is provided through a first fluid passage and a second fluid 604 is provided through a second fluid passage, as described above. Air may be introduced to the system to swirl, mix, and provide oxygen for the combustion process. In FIG. 6, the air is indicated as a third fluid 606. The third fluid 606 (e.g., air) may be supplied into the nozzle assembly 600 through an air inflow tube 608 (third fluid inner flow 606*a*) and an outer vane swirl assembly 650 (third fluid outer flow 606*b*). The air within the air inflow tube 608 may be swirled or rotated as it passes over or through a helical inflow vane assembly 610. As the fuel fluids 602, 604 (e.g., gas and liquid) are passed through the nozzle assembly 600, the flows will be joined together and mixed with the third fluid 606 (i.e., third fluid inner flow 606*a* and third fluid outer flow 606*b*). Some of the third fluid 606 may be directed through a guide swirler 612. The guide swirler 612 may be installed and arranged radially outboard of the nozzle assembly 600 at the outlet of the nozzle assembly 600 and may surround the outer vane swirl assembly 650. The guide swirler 612 is configured to impart swirl to air flowing through a passage 607 of the guide swirler 612, while an array of cooling holes 609 provide cooling to the outside surface of the passage 607. The swirl imparted to the air flowing through the passage 607 of the guide swirler 612 may help control the fuel flows, and mixing thereof, as the flows exit the nozzle assembly 600.

As shown, the second fluid 604 may be passed between an annular gas passage 614. As the second fluid 604 reaches the outlet end of the nozzle assembly 600, it will be passed through a plurality of angled vanes 616. The angled vanes 616 may be defined by vanes or other angled walls that are configured to rotate and swirl the second fluid 604 as it is mixed with the other fluids 602, 606. When hydrogen is introduced into the second fluid 604 (e.g., mixture of hydrogen with other fuel, or hydrogen only), the hydrogen may be disrupted at the angled vanes 616 and cause vane wakes that can negatively impact the nozzle assembly 600 and/or the combustion provided thereby.

In view of this, embodiments of the present disclosure are configured to allow use of hydrogen within fuel injectors, and particularly in dual-fuel fuel injectors. In accordance with embodiments of the present disclosure, fuel injector aerodynamics are modified to isolate vane wakes from the flame allowing operation of the fuel injector with high levels of hydrogen content in the fluid (e.g., up to 100%). In accordance with some embodiments of the present disclosure, an inner swirl strength may be reduced, the gas-fuel swirler may be moved upstream relative to the configuration shown in FIGS. 5-6, and a constricting of the gas-fuel passage downstream of the gas-fuel swirler can enable acceleration of the gas-fuel velocity at the exit, thereby isolating the flame from the vane wakes.

Figure 7:
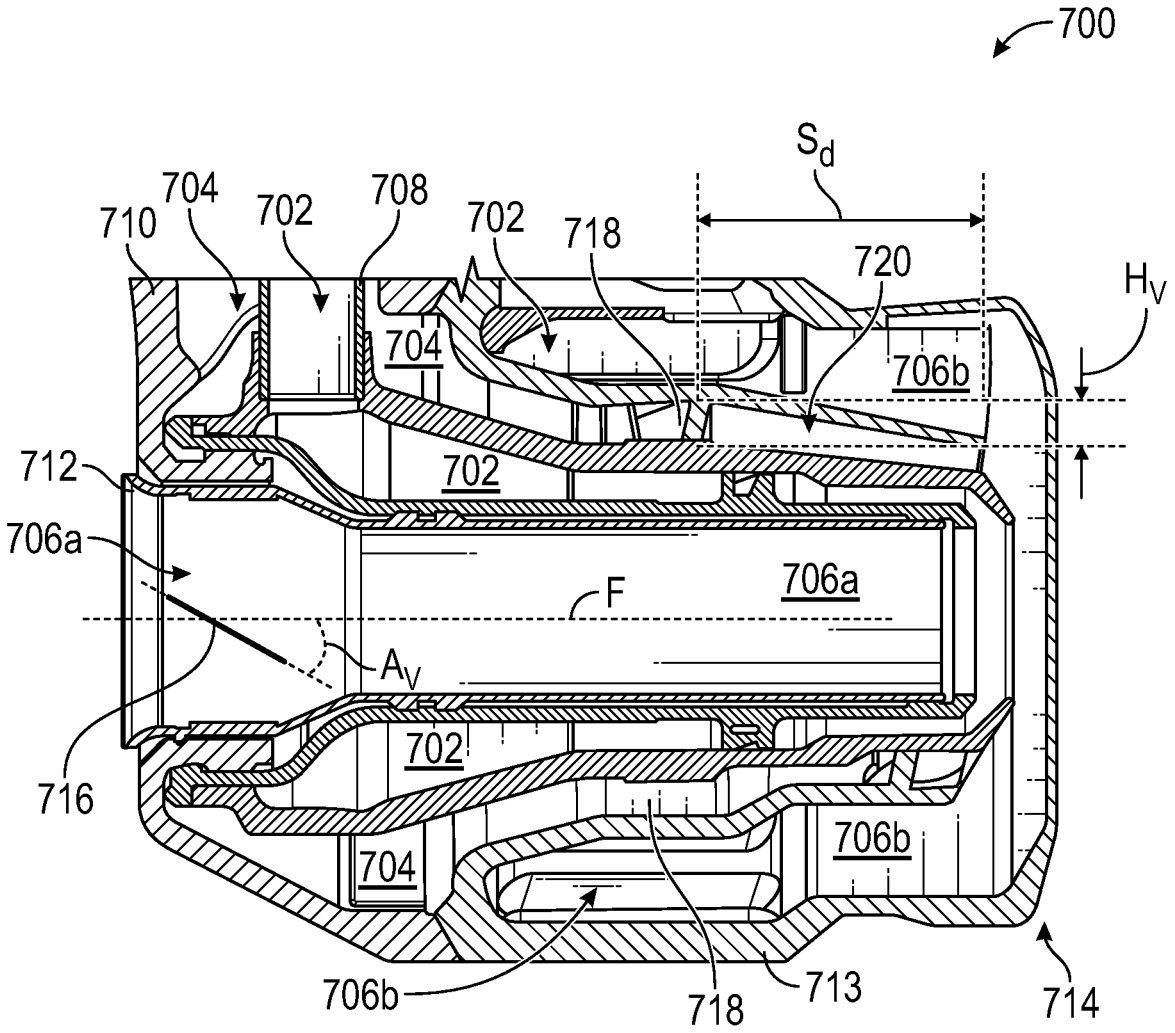
FIG. 7 is a schematic illustration of a nozzle assembly in accordance with an embodiment of the present disclosure.

Referring now to FIG. 7, a schematic illustration of a nozzle assembly 700 in accordance with an embodiment of the present disclosure is shown. The nozzle assembly 700 may be similar to that shown and described above, including a first fluid passage 702 configured to supply a first fluid into and through the nozzle assembly 700, a second fluid passage 704 configured to supply a second fluid into and through the nozzle assembly 700, and a third fluid passage 706*a*, 706*b* configured to supply a third fluid into and through the nozzle assembly 700. In some embodiments, the first fluid may be a liquid fuel, the second fluid may be a gaseous fuel, and the third fluid may be air. The first fluid passage 702 may be defined, in part, within a tube 708. The second fluid passage 704 may be defined, in part, between an exterior of the tube 708 and an interior of a housing 710. The third fluid passage 706*a*, 706*b* (collectively "third fluid passage 706") may be formed of two separate flow path of an associated third fluid. For example, an inner third fluid passage 706*a* may be defined within an inner airflow tube 712 and an outer third fluid passage 706*b* may be defined within an outer vane swirl assembly 713. The three fluids may be mixed together for combustion at an outlet 714 of the nozzle assembly 700.

The first and second fluid passages 702, 704 may be substantially similar to that shown and described above, and the third fluid passages 706*a*, 706*b* are defined within the inner airflow tube 712 and the outer vane swirl assembly 713. The inner airflow tube 712 includes an inflow vane assembly 716. In this embodiment, the inflow vane assembly 716 comprises a number of vanes that are arranged to provide less swirl than prior configurations. For example, the inflow vane assembly 716 of FIG. 7 may have a swirl number (SN) of SN<0.4. This is in contrast to prior configurations that have swirl numbers of SN≥1.0. This is achieved by having vanes of the inflow vane assembly 716 angled at a lower angle relative to an axis F of the nozzle assembly 700, as compared to the angle of the vanes of prior configurations. For example, the vanes of the inflow vane assembly 716 of the nozzle assembly 700 may have a vane angle A, of 20°-40° relative to the axis F, as compared to a vane angle of prior configurations set to be between 60°-85°. This lower angle means that the vanes of the inflow vane assembly 714 will not force as much rotation or swirl into the airflow that flows through the inner airflow tube 712.

Accordingly, the air that exits the inner airflow tube 712 at the outlet 714 will have a higher axial velocity along the axis F. For example, under prior configurations, the axial velocity of the air in the inner airflow tube may be about three times less as compared to embodiments of the present disclosure and may have negative velocities. In contrast, the inner airflow tube 712 of embodiments of the present disclosure may increase an axial velocity of the flow and eliminate negative velocities. Because the vanes of the inflow vane assembly 714 are more shallowly angled, the number of vanes may be increased. For example, in a typical inflow vane assembly, four vanes may be used. These four vanes, due to the high angle of orientation relative to the axis will substantially block a through-flow and cause rotation of all or nearly all air passing therethrough. However, with the lower angle of orientation, it may be necessary to increase the number of vanes (e.g., increase from four to eight) to ensure that some amount of rotation and swirling is imparted to the airflow.

The nozzle assembly 700 may also include a modification of the openings or gas swirler of the second fluid flow. In the embodiments of FIGS. 5-6, the angled vanes 540, 616 located at the exit of the respective second fluid passage. However, as shown in FIG. 7, the nozzle assembly includes angled vanes 718 (e.g., vanes or gas swirler) that are arranged farther upstream from the outlet 714 that the prior configurations. For example, in some embodiments, the angled vanes 718 may be positioned a separation distance $S_d$ that is at least five times larger than a radial height of the angled vanes 718 (i.e., $S_d \geq 5 \cdot H_v$). This causes the initial swirling of the second fluid to occur farther upstream than in prior configurations. As such, any wakes that are formed in the flow of the second fluid may be mixed out by the time the second fluid becomes in contact with flow from the outer third fluid passage 706*b*. As such, no flame holding wakes will be formed, even if the second fluid includes a high concentration of hydrogen (e.g., 30%-100%). Flame holding is primarily a function of a local fuel-air ratio and local velocities (e.g., if the local velocity if slower than a flame speed of hydrogen, flame holding wakes may form). The configuration of the nozzle assembly 700 is designed to ensure that the fuel-air ratio and local velocities are sufficient to mitigate or prevent flame holding wakes.

The flow path of the second fluid also includes a tapering passage 720 between the angled vanes 718 and the outlet 714 of the nozzle assembly 700. The tapering passage 720 may have an axial length (relative to the axis F) that is equal to the separation distance $S_d$ (e.g., five times the radial height $H_v$ of the angled vanes 718). Further, the tapering passage 720 may have narrowing feature such that the radial height of the tapering passage 720 decreases (in radial height in an axial direction) from the angled vanes 718 to the outlet 714 of the nozzle assembly 700. This tapering will cause the flow of the second fluid to accelerate and thus exit the nozzle assembly 700 at the outlet 714 at a higher velocity than in prior configurations. As a result, the second fluid (e.g., hydrogen) may mix with air at the outlet 714 with local velocities that are higher than the flame speed.

Although FIG. 7 is illustratively shown having three unique features in combination (e.g., lower angled vanes in the air inflow tube, the set-back openings, and the tapering passage), those of skill in the art will appreciate that nozzle assemblies of the present disclosure may include combinations of two of these aspects, or even merely one. For example, the nozzle assemblies shown in FIGS. 4A-4B, 5, and 6 can incorporate one or more of the lower angled vanes in the air inflow tube, the set-back openings, and the tapering passage. In some embodiments, the combination of the lower angled vanes in the air inflow tube, the set-back openings, and the tapering passage may all function to provide improvements for reducing the impacts of incorporating higher concentrations of hydrogen into a fuel system for a turbine engine. It will be appreciated that each of the above described features may individually provide such benefits, with the combination thereof providing increasing benefits. Without such features, the inclusion of hydrogen may be limited to 30% or less. However, through the incorporation of one or more of the features described herein, the hydrogen content of a fuel may be increased significantly as the second fluid of the multi-fluid combustion process (e.g., hydrogen content ≥30%, and up to 100% hydrogen).

Advantageously, embodiments described herein provide for improved fuel nozzle assemblies for use with gas turbine engines (e.g., industrial or aircraft applications). The features of the nozzle assembly include reducing a swirl of air within an air inflow tube through lower angled vanes. This results in a higher velocity airflow at the outlet of the air inflow tube, which can aid in pushing or forcing fluids at the outlet of the nozzle assembly away from the nozzle assembly. Further, the use of a set-back of openings (swirler openings) in a gaseous fluid (e.g., hydrogen or hydrogen mixture) from an outlet can prevent wake formation in the gaseous fluid at the outlet, and thus reduce the ability for hydrogen flames to form. Additionally, advantageously, the use of a tapering passage in the gaseous fluid passage can force the fluid flow to increase in velocity, thus lower the opportunity for wakes to form and to eject the fluid at a relatively high velocity, reducing the chance for flames to form at the outlet of the nozzle assembly.

The use of the terms "a", "an", "the", and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. As used herein, the terms "about" and "substantially" are intended to include the degree of error associated with measurement of the particular quantity based upon the equipment available at the time of filing the application. For example, the terms may include a range of ±8%, or 5%, or 2% of a given value or other percentage change as will be appreciated by those of skill in the art for the particular measurement and/or dimensions referred to herein. It should be appreciated that relative positional terms such as "forward," "aft," "upper," "lower," "above," "below," and the like are with reference to normal operational attitude and should not be considered otherwise limiting.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. A fuel injector for a gas turbine engine comprising:

a housing;

a tube arranged in the housing and defining a portion of a first fluid passage therein, the first fluid passage configured to contain a first fluid, wherein a second fluid passage is defined, in part, between an exterior surface of the tube and an interior surface of the housing, the second fluid passage configured to contain a second fluid;

an inner airflow tube having an inflow vane assembly, the air inflow tube arranged along a nozzle axis, said inner airflow tube defining an inner third fluid passage and configured to contain a third fluid, wherein the first fluid passage extends axially at a position radially outward from the inner airflow tube, and the second fluid passage extends axially at a position radially outward from the first fluid passage; and a nozzle outlet configured to receive each of the first fluid, the second fluid, and the third fluid to cause mixing thereof, wherein the inflow vane assembly comprises a plurality of vanes, wherein each vane of the plurality of vanes is angled relative to the nozzle axis at an angle between 20° and 40°;

a plurality of angled vanes arranged along the second fluid passage of the second fluid, wherein the angled vanes are positioned a separation distance Sa from the nozzle outlet a distance that is equal to or greater than five times a radial height of the plurality of angled vanes.

2. The fuel injector of claim 1, wherein the second fluid passage comprises a tapering portion extending from the plurality of angled vanes to the nozzle outlet, wherein the tapering portion has a decreasing radial height that decreases from the plurality of angled vanes to the outlet.

3. The fuel injector of claim 1, wherein the second fluid passage comprises a tapering portion at an end of the second fluid passage that exits to the nozzle outlet, wherein the tapering portion has a decreasing radial height that decreases in dimension in a direction toward the nozzle outlet.

4. The fuel injector of claim 1, wherein the inflow vane assembly comprises eight vanes.

5. The fuel injector of claim 1, wherein the second fluid is a gaseous fuel comprising at least 30% hydrogen.

6. The fuel injector of claim 1, wherein the second fluid is a gaseous fuel comprising 100% hydrogen.

7. The fuel injector of claim 1, wherein the first fluid is a liquid fuel and the third fluid is air.

8. The fuel injector of claim 1, further comprising an outer third fluid passage defined radially outward relative to the first fluid passage relative to the nozzle axis and configured to supply a portion of the third fluid therethrough.

9. A fuel injector for a gas turbine engine comprising:

a housing;

a tube arranged in the housing and defining a portion of a first fluid passage therein, the first fluid passage configured to contain a first fluid, wherein a second fluid passage is defined, in part, between an exterior surface of the tube and an interior surface of the housing, the second fluid passage configured to contain a second fluid;

an inner airflow tube having an inflow vane assembly, the air inflow tube arranged along a nozzle axis, said inner airflow tube defining an inner third fluid passage and configured to contain a third fluid, wherein the first fluid passage extends axially at a position radially outward from the inner airflow tube, and the second fluid passage extends axially at a position radially outward from the first fluid passage;

a nozzle outlet configured to receive each of the first fluid, the second fluid, and the third fluid to cause mixing thereof; and a plurality of angled vanes arranged along the second fluid passage of the second fluid, wherein the angled vanes are positioned a separation distance $S_d$ from the nozzle outlet a distance that is equal to or greater than five times a radial height $H_v$ of the plurality of angled vanes.

10. The fuel injector of claim 9, wherein the inflow vane assembly comprises eight vanes.

11. The fuel injector of claim 9, wherein the second fluid is a gaseous fuel comprising at least 30% hydrogen.

12. The fuel injector of claim 9, wherein the second fluid is a gaseous fuel comprising 100% hydrogen.

13. The fuel injector of claim 9, wherein the first fluid is a liquid fuel and the third fluid is air.

14. The fuel injector of claim 9, further comprising an outer third fluid passage defined radially outward relative to the first fluid passage relative to the nozzle axis and configured to supply a portion of the third fluid therethrough.

15. A fuel injector for a gas turbine engine comprising:

a housing;

a tube arranged in the housing and defining a portion of a first fluid passage therein, the first fluid passage configured to contain a first fluid, wherein a second fluid passage is defined, in part, between an exterior surface of the tube and an interior surface of the housing, the second fluid passage configured to contain a second fluid;

an inner airflow tube having an inflow vane assembly, the air inflow tube arranged along a nozzle axis, said inner airflow tube defining an inner third fluid passage and configured to contain a third fluid, wherein the first fluid passage extends axially at a position radially outward from the inner airflow tube, and the second fluid passage extends axially at a position radially outward from the first fluid passage; and a nozzle outlet configured to receive each of the first fluid, the second fluid, and the third fluid to cause mixing thereof, wherein the second fluid passage comprises a tapering portion at an end of the second fluid passage that exits to the nozzle outlet, wherein the tapering portion has a decreasing radial height that decreases in dimension in a direction toward the nozzle outlet; and a plurality of angled vanes arranged along the second fluid passage of the second fluid, wherein the angled vanes are positioned a separation distance Sa from the nozzle outlet a distance that is equal to or greater than five times a radial height $H_v$ of the plurality of angled vanes.

16. The fuel injector of claim 15, wherein a length of the tapering portion is equal to the separation distance $S_d$.

* * * * *